United States Patent [19]

Kelley et al.

[11] Patent Number: 4,831,842

[45] Date of Patent: May 23, 1989

[54] COOLING JACKET

[76] Inventors: James T. Kelley, 13516 Silver Lake Dr.; James E. Barlow, 12233 Witt Rd., both of Poway, Calif. 92064

[21] Appl. No.: 144,519

[22] Filed: Jan. 15, 1988

[51] Int. Cl.[4] ..... F25D 3/08

[52] U.S. Cl. .....62/457.4; 62/372; 62/530; 220/903

[58] Field of Search ..... 62/530, 372, 457; 220/903

[56] References Cited

U.S. PATENT DOCUMENTS

| | | | |
|---|---|---|---|
| Re. 26,724 | 11/1969 | Paquin | 62/457 |
| 2,154,933 | 4/1939 | Hadsell | 62/530 |
| 2,779,495 | 1/1957 | Davis | 62/530 |
| 4,183,226 | 1/1980 | Moore | 62/457 |
| 4,299,100 | 11/1981 | Crisman et al. | 62/457 |
| 4,324,111 | 4/1982 | Edwards | 62/530 X |
| 4,344,303 | 8/1982 | Kelly, Jr. | 62/457 X |
| 4,383,422 | 5/1983 | Gordon et al. | 62/457 |
| 4,399,668 | 8/1983 | Williamson | 62/372 X |
| 4,514,993 | 5/1985 | Johnson | 62/372 |
| 4,676,247 | 6/1987 | Van Cleve | 62/530 X |

*Primary Examiner*—Lloyd L. King

*Attorney, Agent, or Firm*—Whann & Connors

[57] ABSTRACT

Disclosed is a cooling jacket for a beverage container comprising a hollow cylindrical structure made of a washable, durable fabric coated with a rubber-type insulating backing and lined with a receptacle member for a plurality of liquid tight packets containing a cold retention substance. The cooling jacket is placed in a freezer to allow the cold retention substance to freeze. Then the beverage container is placed in the cooling jacket and maintained at a cold temperature.

9 Claims, 2 Drawing Sheets

COOLING JACKET

BACKGROUND OF THE INVENTION

1. Field of the Invention

This invention relates to a cooling jacket for a beverage container, such as soft drink aluminum cans, beer bottles, etc., and particularly, to a jacket which is wahsable and is lined with a receptacle member containing a cold retention substance.

2. Background Discussion

It is a common practice to employ an insulating jacket to hold a beverage container, such as a soda can or beer bottle. Typically, the jacket is simply a hollow cylindrical structure made of an insulating material. The cavity formed by the structure has the diameter just slightly larger than the diameter of the container and it is a length just about equal to the length of the container. This enables the user to place the container in the jacket so that the jacket surrounds substantially the entire surface area of the container leaving only the top portion exposed to permit the user to drink from the container. Generally, these jackets do not lend themselves to be periodically washed, nor do they employ a cold retention substance to facilitate keeping the container cool.

SUMMARY OF THE INVENTION

The present invention provides a cooling jacket for a beverage container which comprises a tubular wall member which forms a cavity into which the container is placed. This tubular wall member is made of a washable fabric and it is lined with a receptacle member containing a cold retention substance. The cooling jacket is placed in a freezer for a sufficient period of time to allow the cold retention substance to freeze. The cold retention substance is typically a liquid which upon freezing will ordinarily take considerably more time to thaw than simply frozen water. Although water could be used as the cold retention substance, there have been developed alternates which have superior cold retention properties than water. These are preferred.

There are several features of this invention which contribute to its utility, no single one of which is solely responsible for this desirable attribute. Without limiting the scope of this invention as expressed by the claims, its more prominent features will now be discussed briefly. After considering this discussion, and particularly after reading the section of this application entitled Detailed Description of the Preferred Embodiment, one will understand how the features of this invention provide the utility of this invention.

One feature of this invention is the use of a fabric made of a polymeric yarn, such as nylon, which is durable and washable. This fabric is formed into a rectangular sheet and one side is coated with a rubber-type backing. The sheet is then formed into a hollow cylinder, with the abutting edges of the sheet being glued together at the seam to provide the cylindrical structure. This cylindrical structure will have a diameter approximately equal to the diameter of the beverage container which it is to hold and a height just slightly less than the height of the container. Since the nylon fabric with rubber backing has the ability to stretch and then spring back to its original shape, the cylindrical structure will accommodate containers having different diameters.

This elasticity of the wall member is an important feature of this invention.

The second feature of this invention is the use of a liner element which is sewed or otherwise secured to the inside wall of the tubular member. The liner will contain one or more liquid tight receptacles which hold the cold retention substance. Cyropak, Inc. provides receptacles containing a suitable cold retention substance which is non-toxic and biodegradable. The preferred receptacle is one which holds approximately nine milliliters of cold retention substance in a plastic packet. These plastic packets or receptacles are sewn in between two sheets of thin polyester cotton to form the liner that is sown to the inside wall of the wall member.

The third feature of this invention is that the bottom is closed to retain any condensed moisture within the jacket. Many conventional jackets have a hole in the bottom that allows air to escape as the beverage container is slipped into the open mouth of the jacket. This is necessary because such conventional jackets have a tight fitting mouth that inhibits the escape of air through a space between the container wall and the jacket wall. In accordance with this invention, there are vents provided in the liner element which allow air to escape out these vents as the container is placed in the cooling jacket of this invention.

The fourth feature of this invention is the use of support rings at the ends of the jacket to assist in maintaining its shape. Preferably, these rings are formed by solidification of the adhesive used in bonding the linear element to the tubular wall member.

BRIEF DESCRIPTION OF THE DRAWING

The preferred embodiment of this invention illustrating all of its features will now be discussed in detail in connection with the accompanying drawing. The drawing, wherein like numeral indicate like parts, depicts this preferred embodiment of this invention, in which.

DESCRIPTION OF THE PREFERRED EMBODIMENT

Figure 1:
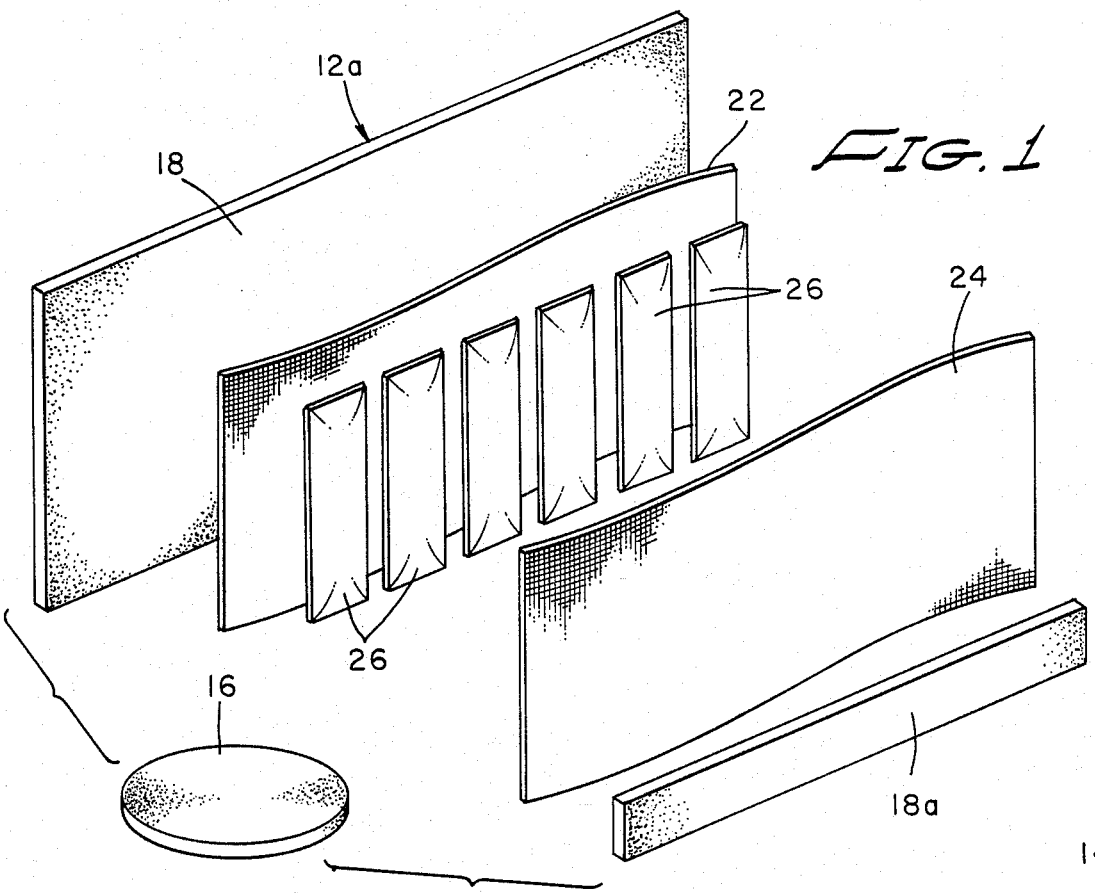
FIG. 1 is an exploded view of the components of this invention prior to their being assembled into the cooling jacket.

As best illustrated in FIGS. 3 through 7, the cooling jacket 10 of this invention includes a tubular wall member 12, a liner 14 sewn or otherwise secured firmly to the inside of the tubular wall member, and a bottom 16.

The tubular wall member 12 is made from a rectangular sheet **12*a* of nylon fabric having a thin coating, approximately an eighth of an inch, of neoprene (rubber) backing 18. As will be discussed in greater detail below, a rubber-backed nylon strip 18*a* is also employed. A suitable fabric may be purchased from Rubatex Corporation of California. This rubber-backed nylon fabric is washable, and the nylon surface 20 (FIG. 5**) may be printed upon, for example, using silk screen printing techniques. This is desirable to display promotional material, such as trademarks.

Figure 2:
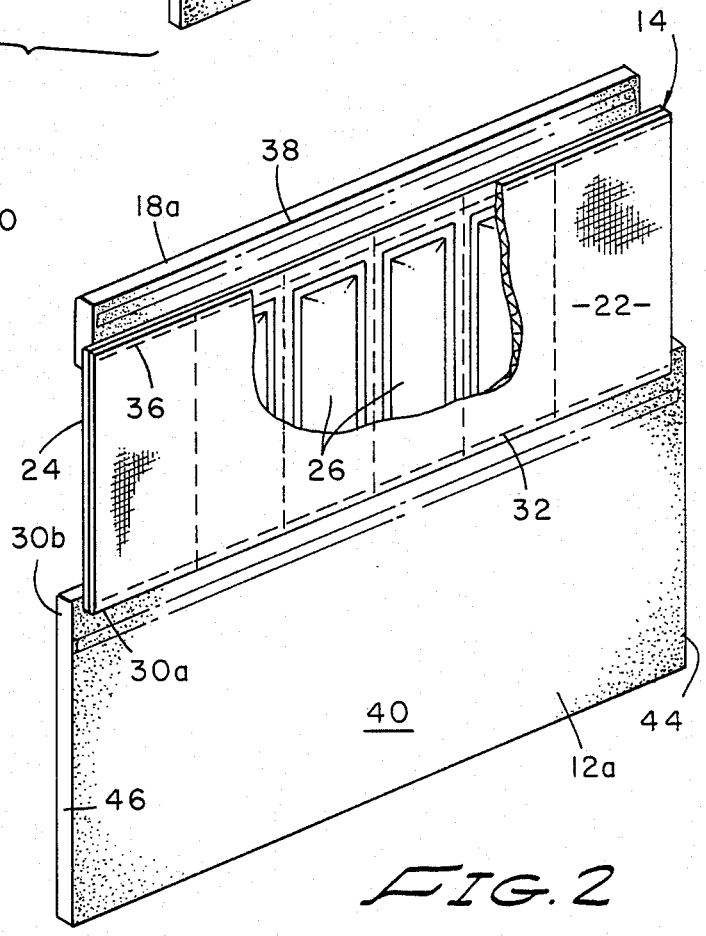
FIG. 2 is a perspective view of the partial assembly of the components.
Figure 3:
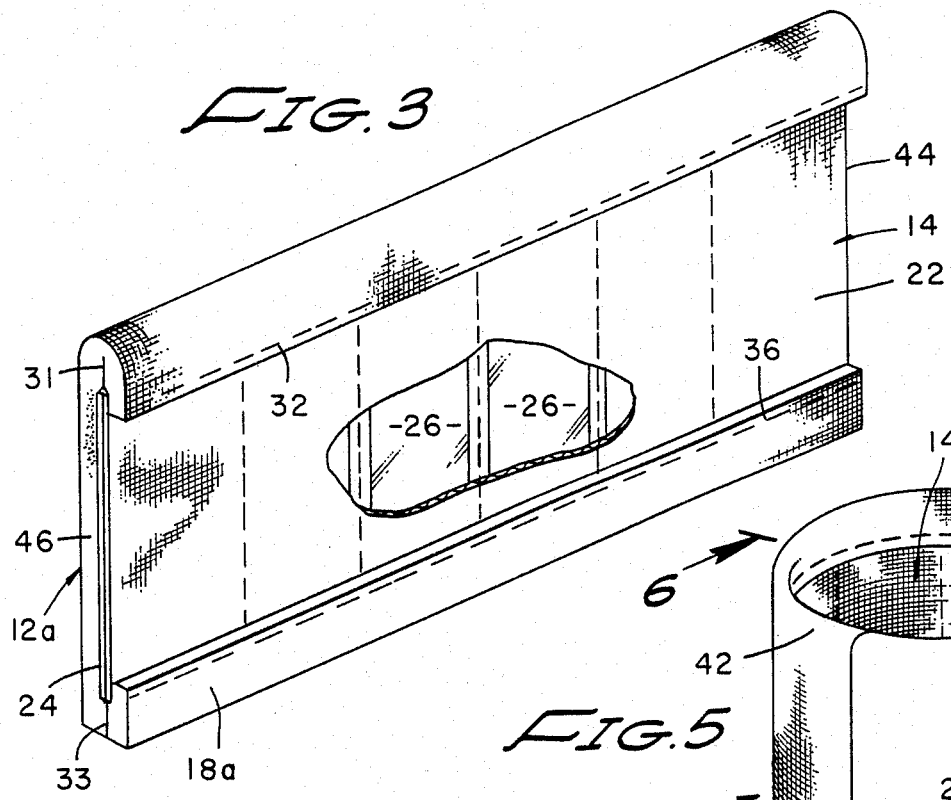
FIG. 3 is a perspective view of the wall member of this invention prior to it being formed into a cylindrical structure.
Figure 7:
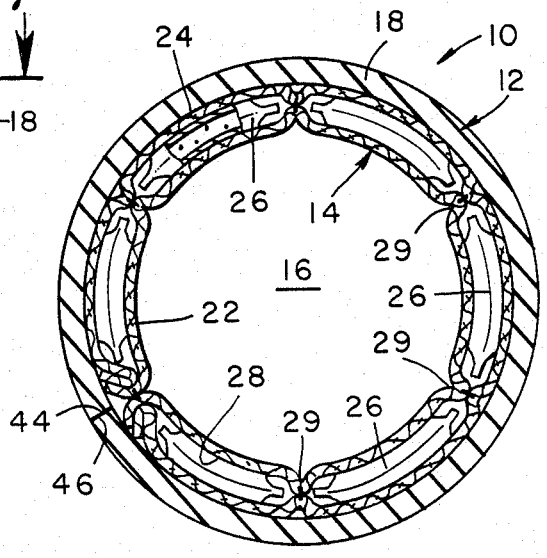
FIG. 7 is a cross-sectional view taken along line 7—7 of FIG. 6.

As shown in FIGS. 1 through 3, the liner 14 is formed from two sheets 22 and 24 of cotton polyester fabric. These two sheets 22 and 24 have a length which is essentially equal to the length of the rubber-backed nylon sheet 12*a* forming the tubular wall, but a height which is substantially less than the height of the sheet 12*a*. For example, the rubber-backed nylon sheet 12*a* will have a height of approximately $4\frac{3}{4}$ inches and a length of 9 inches, as compared to a height of $3\frac{3}{4}$ inches by 8 inches for the sheets 22 and 24 of cotton polyester fabric. Separate packets 26 containing a cold retention substance are placed in between the two sheets 22 and 24 of liner fabric. The two sheets of fabric are then sown together, with individual packets 26 being sewn in position in individuals pouches 28 so that the packets form a row, but are adapted to move relative to one another to enable the liner 14 to be formed into a cylindrical structure. As shown in FIG. 7, vents 29 are formed by the seams between individual pouches 28 that allow air to escape through when a container 50 is placed in the cooling jacket 10.

Figure 4:
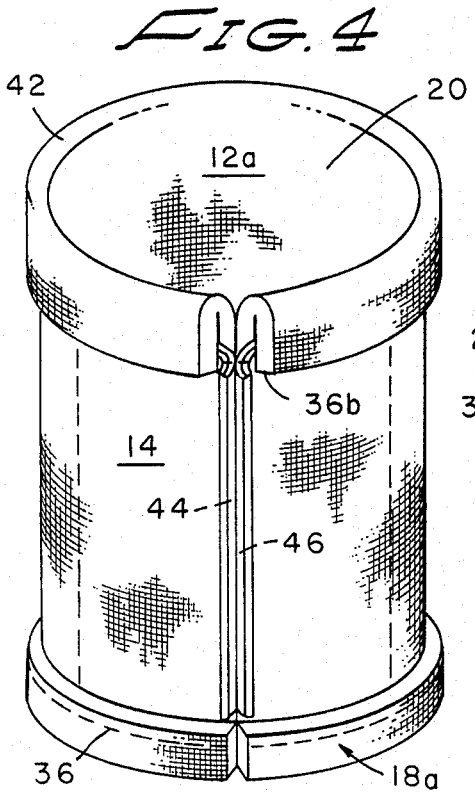
FIG. 4 is a perspective view of the assembly of liner and rubber backed nylon sheet with one edge of the sheet and liner folded over to form the lip of the jacket of this invention.
Figure 5:
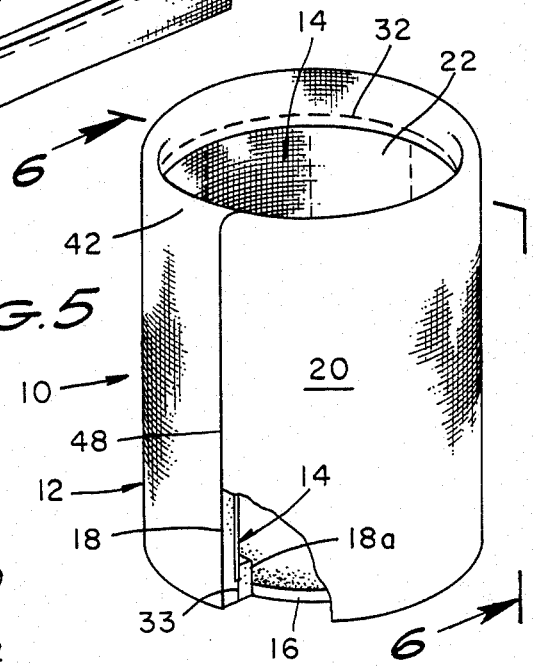
FIG. 5 is a perspective view of the cooling jacket of this invention with a section broken away.

With the packets 26 sewn in the liner as illustrated, the liner 14 is placed adjacent the rubber side of the rubber-backed nylon fabric with the edges 30*a* and 30*b* overlapping as shown in FIG. 2. These overlapping edges are then sewn together along a seam line 32. The strip 18*a* is also placed adjacent the liner 14 as shown in FIG. 2 with the edges overlapping and sewn together along a seam line 36. A bead of glue is applied to the side 40 adjacent the seam line 32 and the liner 14, with strips 18*a* attached to it, is then folded inwardly approximately about the seam line 32. A bead of glue is also applied to the rubber-backed side 38 of the strip 18*a* to glue it to the rubber-backed side 40 along the bottom edge. The overlapping edge 30*b* of the sheet 12*a* is then folded over as shown in FIG. 4 to form a rounded lip 42. The assembly of liner 14 and sheet 12*a* is flexible and may be formed into a tubular or cylindrical structure, with either the liner forming an exterior surface as shown in FIG. 4 or the nylon surface 20 forming the exterior surface as shown in FIG. 5, by simply bringing the side edges 44 and 46 into an abutting relationship. Upon bringing these edges 44 and 46 together, neoprene cement is then used to bind these edges together and form the seam line 48 of the tubular wall member 12. The nylon fabric forms the exterior surface 20 of the tubular wall member 12 and the liner 14 forms the inside wall. Upon hardening, the two beads of glued applied to the two opposed elongated edges of the sheet 12*a* form rigid support rings 31 and 33 (FIG. 6) for the cooling jacket 10.

The bottom 16 is simply a circular piece corresponding to the circular dimensions of the tubular structure. It is cut from a piece of rubber-backed nylon fabric which is the same as that used to form the exterior of the tubular wall member. This circular bottom 16 is then placed inside the bottom end of the tubular wall member 12 and glued into position using a neoprene cement.

The cooling jacket 10 thus formed comprises the tubular wall member 12 made of a rubber-backed nylon fabric with a liner 14 containing a series of parallel arranged packets 26 containing the cold retaining substance. These packets 26 plus the rings 31 and 33 provide structural rigidity to the jacket 10 so that it has the ability to rest on its bottom 16 without the fabric walls collapsing. One can even apply a downward pressure on the jacket 10 to cause it to collapse, but upon release of the pressure, it springs back to its original upright condition. Because of the ability of the rubber-coated nylon fabric to stretch, it will be able to accommodate beverage containers having different sized diameters.

Figure 6:
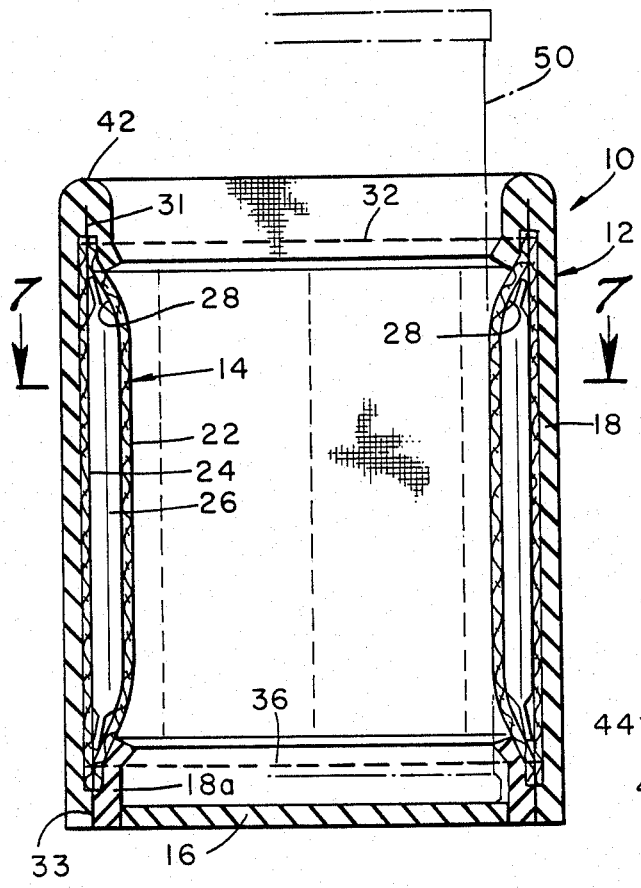
FIG. 6 is a cross-sectional view taken along line 6—6 of FIG. 5.

To use this cooling jacket one would first place it in a freezer to allow the cold retention substance to freeze. Upon removal from the freezer, a beverage container 50 is placed in the jacket 10, as shown in FIG. 6. As the container 50 is forced into the open mouth defined by the lips 42, air escapes through the vents 29. The user then grips the outside of the jacket 10, with the rubber backing 18 acting as an insulator to keep the hand of the user both dry and relatively warm. The cooling jacket 10 illustrated herein will keep a beverage cold for approximately two hours. That is, a soda placed in the jacket 10 will maintain its temperature for approximately two hours. When the user finishes consuming the beverage, he removes the container 50 and disposes of it, and then either places the cooling jacket again into the freezer or, if it needs to be cleaned, simply washes and dries it and then returns it to the freezer.

SCOPE OF THE INVENTION

The above description presents the best mode contemplated of carrying out the present invention as depicted in the preferred embodiment disclosed. The combinations of features illustrated in this embodiment provides its utility. This invention is, however, susceptible to modifications and alternate constructions from the embodiment shown in the drawing and described above. Consequently, it is not the intention to limit it to the particular embodiment disclosed. On the contrary, the intention is to cover all modifications and alternate constructions falling within the scope of the invention as generally expressed by the following claims.

We claim:

1. A cooling jacket for beverage container comprising a tubular wall member having an open end which receives the container and a closed bottom, said wall member being made from a washable durable fabric which forms the exterior, with said fabric having applied thereto an insulating backing, said wall member having elasticity so that it may expand to accommodate containers of different diameters, and a liner element secured to the inside of the wall member which holds a plurality of packets containing a cold retention substance which is non-toxic and biodegradable, said packets being aligned longitudinally and covering essentially the entire inside of the wall member and leaving there between vents that allow air to escape from the interior of the jacket as a container is placed in the jacket.

2. The cooling jacket of claim 1 wherein the bottom is made from the same washable durable fabric as the wall member.

3. The cooling jacket of claim 1 wherein the packets are in a fabric liner.

4. The cooling jacket of claim 1 wherein the tubular wall member is made from a generally flat sheet which is formed into a hollow cylindrical structure with the side edges of the sheet abutting each other and being bonded together.

5. The cooling jacket of claim 1 wherein the bottom is a circular piece which is glued in position at one end of the tubular wall member.

6. The cooling jacket of claim 1 wherein the insulating backing is a rubber type material.

7. A cooling jacket for a beverage container comprising a tubular wall member having an open end which receives the container and a closed bottom, said wall member and bottom being made of a washable, durable fabric which forms the exterior and has bonded thereto a rubber-type insulating backing, said wall member being formed from a flat sheet of said fabric with the side edges of the sheet abutting each other and being bonded together to form a cylindrical structure which has elasticity to enable it to expand to accommodate beverage containers of different diameters, and said liner element secured to the inside wall member which holds a plurality of individual liquid type packets containing a cold retaining substance, said packets being aligned in a row and covering essentially the entire inside of the wall member said packets having there between vents that allow air to escape from the interior of the jacket as a container is placed in the jacket.

8. The cooling jacket of claim 7 wherein there are support rings adjacent the open end and closed bottom of the jacket.

9. The cooling jacket of claim 8 wherein the rings are formed by the solidification of an adhesive used to bond the receptacle member to the wall member.

* * * * *